US008740108B1

(12) United States Patent
Caughran

(10) Patent No.: US 8,740,108 B1
(45) Date of Patent: Jun. 3, 2014

(54) ATOMIZER SYSTEM FOR IMPROVED FUEL SYSTEMS

(76) Inventor: David Caughran, Anchorage, AK (US)

( * ) Notice: Subject to any disclaimer, the term of this patent is extended or adjusted under 35 U.S.C. 154(b) by 661 days.

(21) Appl. No.: 12/928,754

(22) Filed: Dec. 17, 2010

(51) Int. Cl.

| | |
|---|---|
| ***F02M 61/02*** | (2006.01) |
| ***F02M 63/00*** | (2006.01) |
| ***B05B 3/02*** | (2006.01) |
| ***B05B 3/00*** | (2006.01) |

(52) U.S. Cl.
USPC ..... 239/5; 239/263.2; 239/263.3; 239/533.2

(58) Field of Classification Search
USPC ..... 239/5, 225.1, 263.1–263.3, 461, 502, 239/533.2, 589, 590, 590.5; 123/445, 470
See application file for complete search history.

(56) References Cited

U.S. PATENT DOCUMENTS

| | | | | |
|---|---|---|---|---|
| 5,645,225 | A * | 7/1997 | Hasegawa et al. | 239/533.12 |
| 5,947,389 | A * | 9/1999 | Hasegawa et al. | 239/533.2 |
| 5,975,433 | A * | 11/1999 | Hasegawa et al. | 239/533.12 |
| 6,047,948 | A * | 4/2000 | Hasegawa et al. | 251/129.18 |
| 2002/0092929 | A1 * | 7/2002 | Arimoto | 239/533.3 |
| 2002/0121264 | A1 * | 9/2002 | Shin | 123/299 |

* cited by examiner

*Primary Examiner* — Darren W Gorman
(74) *Attorney, Agent, or Firm* — Michael J. Tavella

(57) ABSTRACT

In this system, a device is placed inside the injectors on the manifold or inside three different design housings above the combustion chambers of engines. The device is a combine that has a cylinder that has a set of vanes. In one embodiment a small motor is used to turn the cylinder, which helps to atomize the fuel to a fine state. This atomization improves combustion in that the smaller fuel particles can burn more efficiently and more completely than larger drops of fuel that is simply squirted into a cylinder or manifold. In two other embodiments, the cylinder (combine) can be turned with a belt driven by the engine.

20 Claims, 20 Drawing Sheets

ATOMIZER SYSTEM FOR IMPROVED FUEL SYSTEMS

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to atomizer systems for fuel injectors and particularly to atomizer systems for engine fuel injectors, and fuel systems.

2. Description of the Prior Art

Fuel injectors have been in use in different types of engines for many years. A standard fuel injector is designed to inject a measured amount of fuel into a cylinder or manifold. The injectors have a control (such as a solenoid), a plunger and spring. When the solenoid is energized, the plunger is retracted and the injector is then opened to allow a small quantity of fuel to be ejected from the injector under pressure. After the fuel has been injected, the solenoid is de-energized and the spring forces the plunger back to close the injector. While this system is effective, there are ways to improve the delivery of the fuel.

BRIEF DESCRIPTION OF THE INVENTION

The instant invention provides a more efficient fuel delivery system for fuel systems that include fuel injectors, carburetors, throttle bodies and other fuel systems. In this system, a device is placed inside the injectors between the plunger and nozzle, or inside three different designs of housings. The device is a combine that has a cylinder that has a set of vanes. In one embodiment a small motor is used to turn the cylinder. As the cylinder is turned, the vanes are used atomize the fuel to a fine state. This atomization improves combustion in that the smaller fuel particles can burn more efficiently and more completely than larger drops of fuel that are simply squirted into a cylinder or manifold. In two other embodiments, the cylinder (combine) can be turned with a belt driven by the engine.

DETAILED DESCRIPTION OF THE INVENTION

Figure 1:
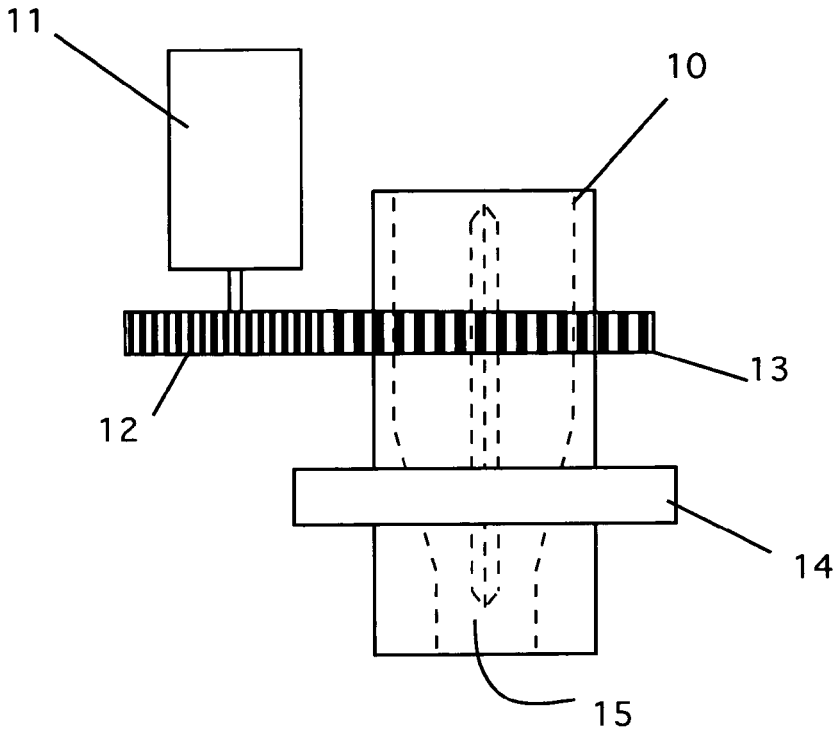
Referring now to FIG. 1, a top elemental detail view of the preferred embodiment of the invention is shown.

Referring now to FIG. 1, a top elemental detail view of one embodiment of the invention is shown. In this view, the key components of the system are shown. First, is the combine 10, which contains the rotating cylinder containing a set of fins or vanes (see FIG. 2). In the preferred embodiment a motor 11 is used to turn the combine it is considered to be one of the means for turning said housing. This is done using gears 12, and 13, which is considered to be a means for driving said housing installed on the housing. There is a journal bearing 14 located on the combine to support the cylinder. The end of the combine has an outlet 15.

Figure 2:
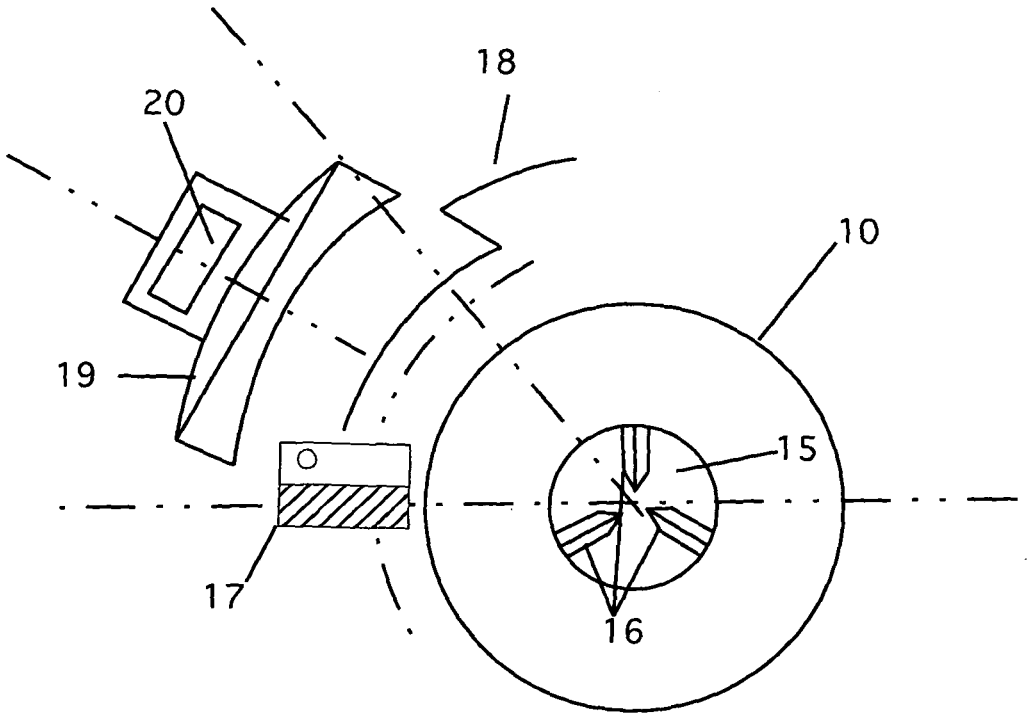
FIG. 2 is a front view of the preferred embodiment.

FIG. 2 is a front view of the first embodiment. Here, the components are shown in actual placement. The combine 10 is shown with the outlet 15. The vanes 16 are shown inside the combine. Note that the vanes 16 are fixed to the sides of the interior of the combine and protrude into the space as shown. Although three vanes are shown, more can be added if desired. The motor 11 is kept in a housing 17 (discussed below). The entire assembly is kept in a housing 18 that is partially shown. The housing 18 has an access cover 19 that has a slot 20 for a tool. The tool is inserted in the slot and is used to pry the lid 19 off the housing.

Figure 2A:
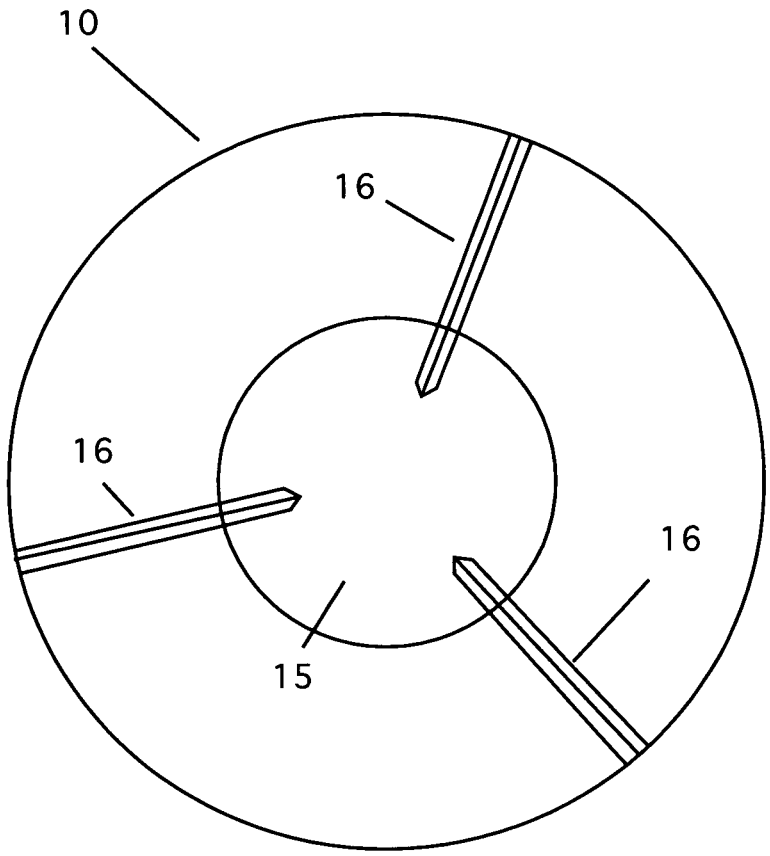
FIG. 2*a* is a front view of the vanes installed in the device.

FIG. 2*a* is a front view of the vanes (fins) installed in the device. In this figure the vanes 16 are shown in the combine 10. Note that the outlet 15 is shown in relation to the vanes.

Figure 3:
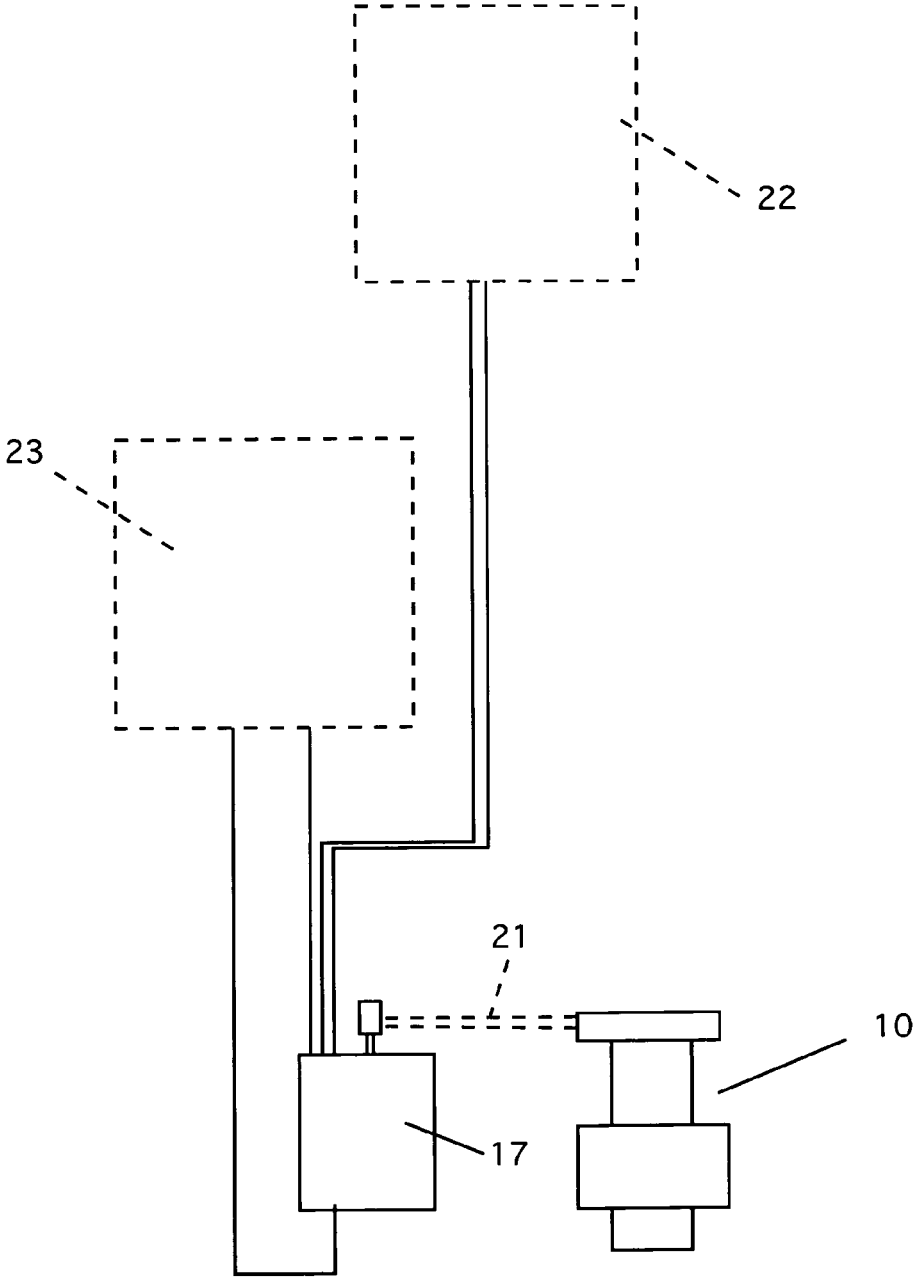
FIG. 3 is a block diagram of the device showing the control systems.

FIG. 3 is a block diagram of the device showing the control systems. Here, the combine 10 is shown with the motor 11 inside the motor housing 17. The dashed lines 21 represent the connection between the motor and the combine. A computer 22 and a filter 23 connect to the motor and the housing. The computer can be a computer used in the engine, or it can be a separate unit. The computer is used to synchronize the operation of the combine with the engine to deliver fuel at the precise time. The filter is used to clean the air that passes through the housing, which cools the motor and removes dirt and debris from the housing. It also keeps gas away from the motor.

Figure 4:
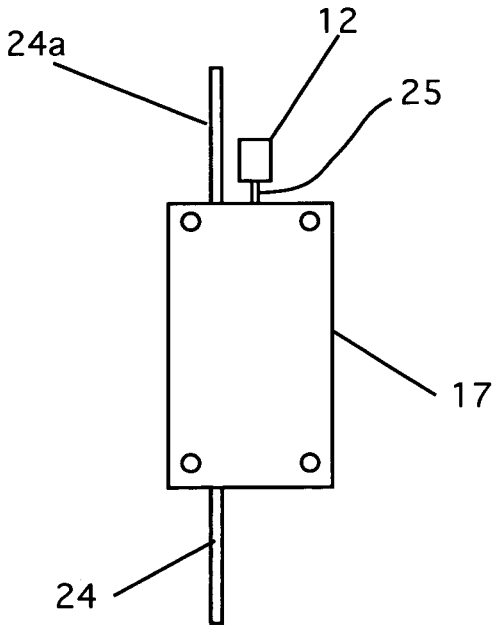
FIG. 4 is a top view of the motor, gear and air tube housing.

FIG. 4 is a top view of the motor, gear and air tube housing. The housing 17 is a rectangular box that holds the motor and an air tube 24 and an air tube 24*a*. The figure also shows the motor shaft 25 onto which the gear 12 is installed.

Figure 5:
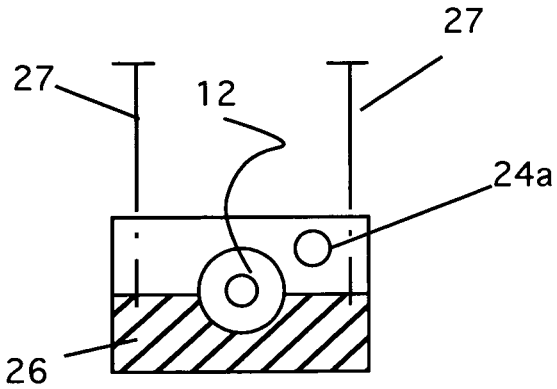
FIG. 5 is a front view of the motor, gear and air tube housing used in a parallel arrangement with the combine.

FIG. 5 is a front view of the motor, gear and air tube housing. Here, the inlet air tube 24*a* and motor are shown in proper special relationship. Note that the housing 17 has a pair of bosses 26 that are used to hold screws 27 that hold the lid of the housing in place.

Figure 5A:
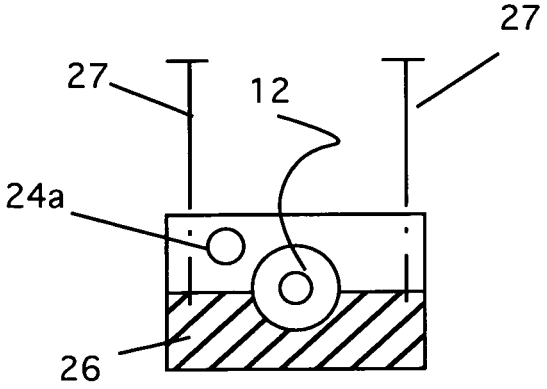
FIG. 5*a* is a front view of the motor, gear and air tube housing used in a top arrangement with a combine.

FIG. 5*a* is a front view of the motor, gear and air tube housing used in a top arrangement with a combine. In this view, the air tube is shown on the other side of the housing to prevent the air from mixing with the gas.

Figure 6:
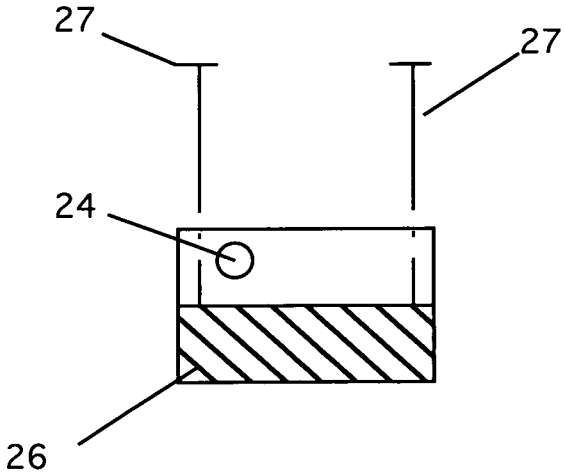
FIG. 6 is a rear view of the motor, gear and air tube housing used in a parallel arrangement with the combine.

FIG. 6 is a rear view of the motor, gear and air tube housing. Note in this view, the motor is not shown. It has only one shaft that exits the housing at the front. Here, the air tube 24 is shown.

Figure 6A:
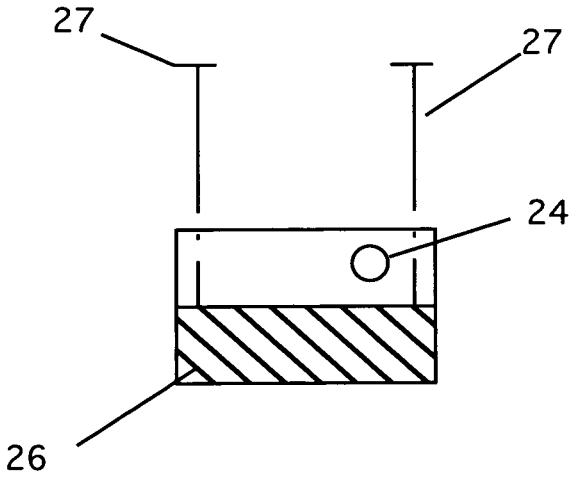
FIG. 6*a* is a rear view of the motor, gear and air tube housing used in a top arrangement with a combine.

FIG. 6*a* is a rear view of the motor, gear and air tube housing used in a top arrangement with a combine. In this view, the air tube is shown on the other side of the housing to prevent the air from mixing with the gas.

Figure 7:
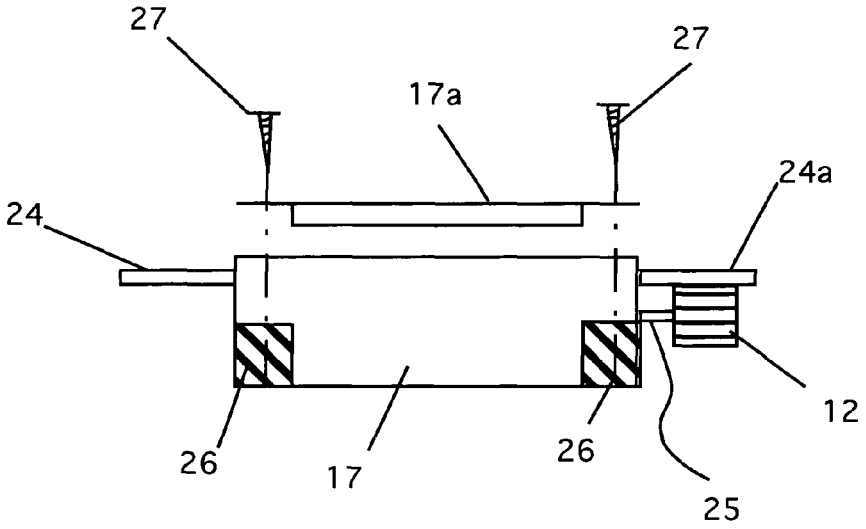
FIG. 7 is a side view of the motor, gear and air tube housing showing the lid removed.

FIG. 7 is a side view of the housing for the motor, gear and air tube, showing the lid removed. In this figure, the bosses 26 are shown at the ends of the housing. Also note that the lid 17*a* is shown. The gear 12 and shaft 25 are also shown.

Figure 8:
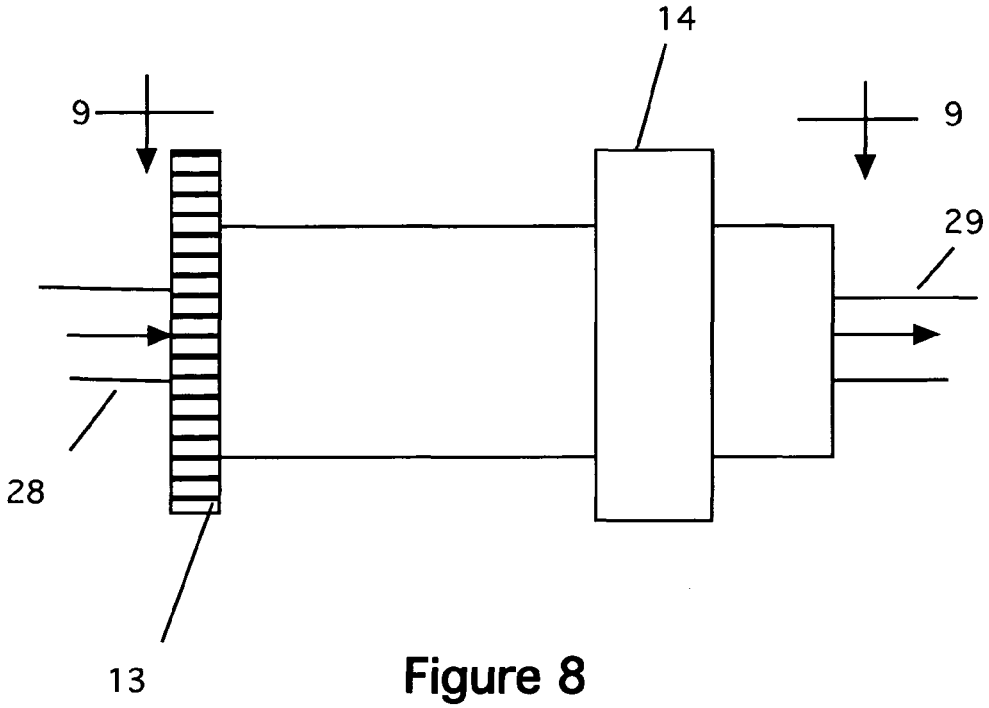
FIG. 8 is a side view of the combine.

FIG. 8 is a side view of the combine. In this figure, the combine 10 is shown with fuel inlet and outlet tubes 28 and 29 showing the fuel flow (arrows). The gear 13 and journal bearing 14 are shown. Fuel is pressure injected into the combine as shown. As it passes through the combine, the rotating body causes the vanes to mix the fuel-air mixture. It then exits the combine as shown.

Figure 9:
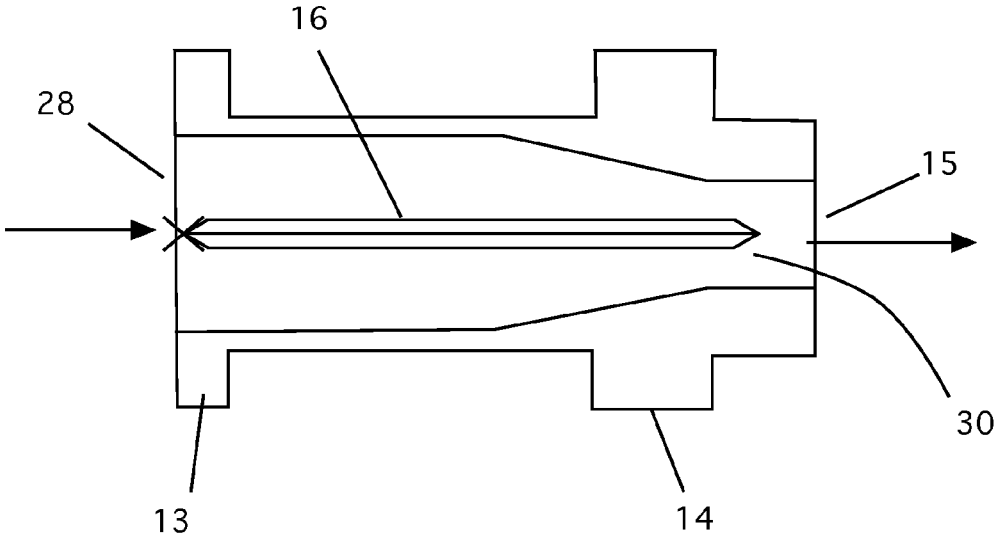
FIG. 9 is a cross-sectional view of the combine taken along the lines 9-9 of FIG. 8.

FIG. 9 is a cross-sectional view of the combine taken along the lines 9-9 of FIG. 8. In this view, one vane 16 is shown. The other vanes are not shown for clarity. Note that this view shows the inlet in which the pressurized air-fuel mixture is injected. As noted able, as it passes through the rotating combine, the vanes mix it further. Finally, near the outlet, a constriction 30 is provided that further increases the pressure and the velocity of the mixture as it is ejected from combine into fuel injector and then into the combustion chamber or manifold.

Figure 10:
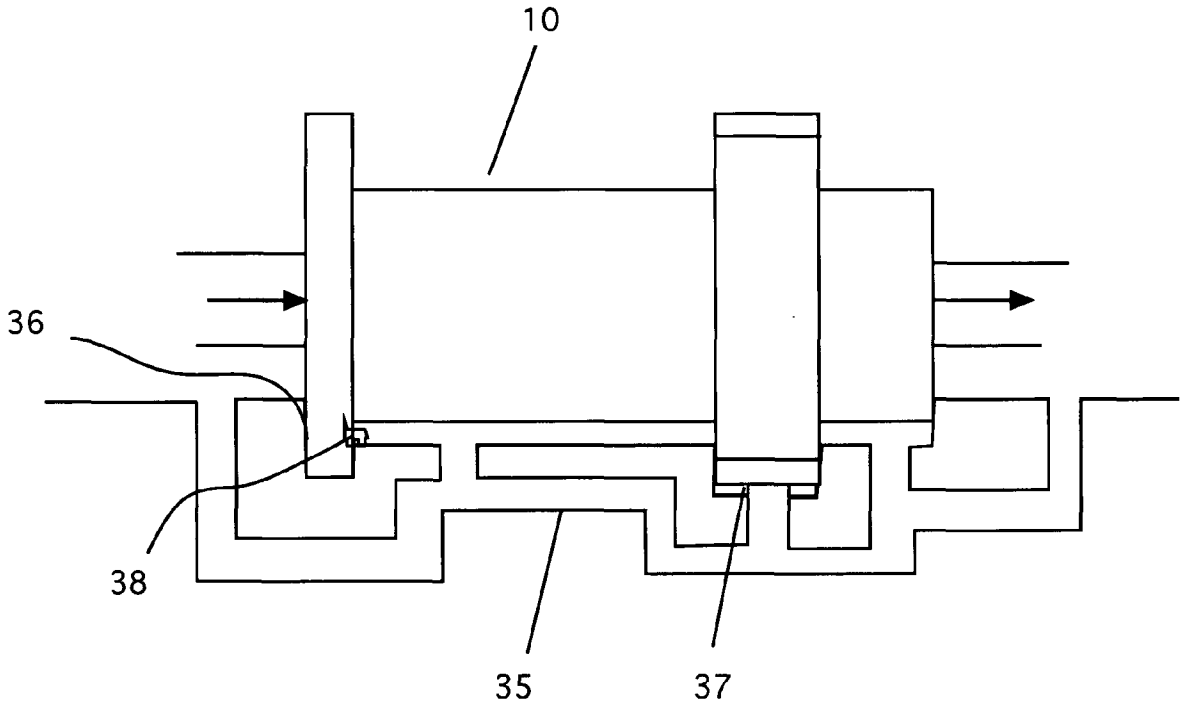
FIG. 10 is a cross-sectional view of the lubrication system for the combine showing bearings for the combine.
Figure 11A:
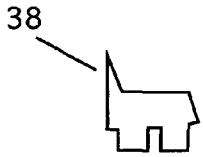
FIGS. 11*a*-11*d* are detail views of the seals for the lubrication system for the combine.
Figure 11C:
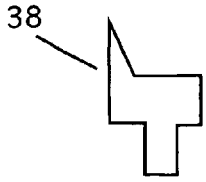
Figure 11B:
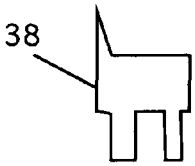
Figure 11D:
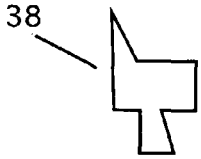

FIG. 10 is a cross-sectional view of the lubrication system 35 for the combine. Here, the combine 10 is shown positioned above the lubrication system. The design is such that the gear and the journal fit into slots 36 and 37 in the system. Lubricant is fed through the system to keep the combine body (housing) and journal properly lubricated. In the preferred embodiment, gas or diesel used in the fuel system is used as the lubricant. Note that seals 38 are provided to ensure the lubricant is contained within the system. The system is lubricated by small drips of gas or diesel fuel that are emitted from the system during its operation.

FIGS. 11*a*-11*d* are detail views of the seals for the lubrication system for the combine. These figures show different shapes of seals that can be used with the lubrication system.

Figure 12:
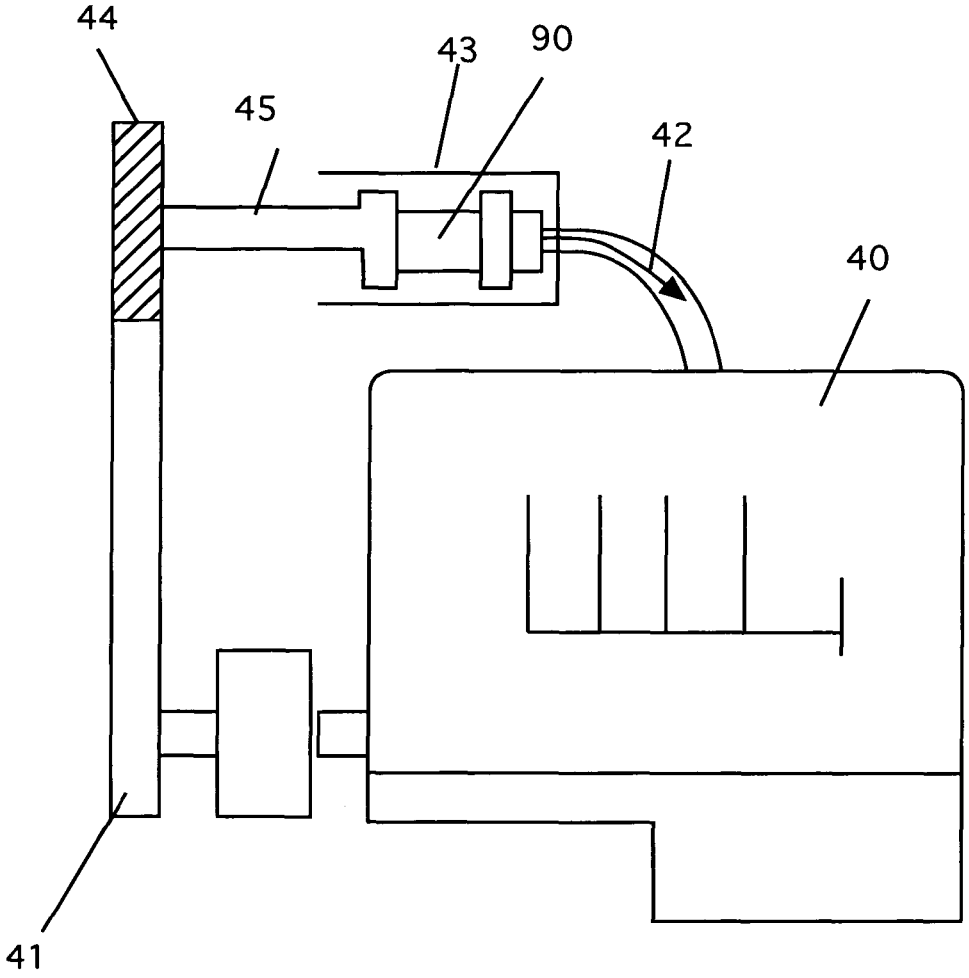
FIG. 12 is a side detail view of a second embodiment that uses an engine with a pulley and belt to drive the system.

FIG. 12 is a side detail view of a second embodiment that uses an engine with a pulley and belt to drive the system. Alternatively, the pulley and belt can be a chain drive or other mechanical drive system. FIG. 12 shows an engine 40 that has a drive belt system 41 and an intake manifold 42. A combine housing 43 is installed adjacent to the intake manifold as shown. It can also be installed at right angles to the manifold. The combine is driven by a belt (or chain) that connects to the main belt drive system at 44 that attaches to a shaft 45 that drives the combine.

Figure 13:
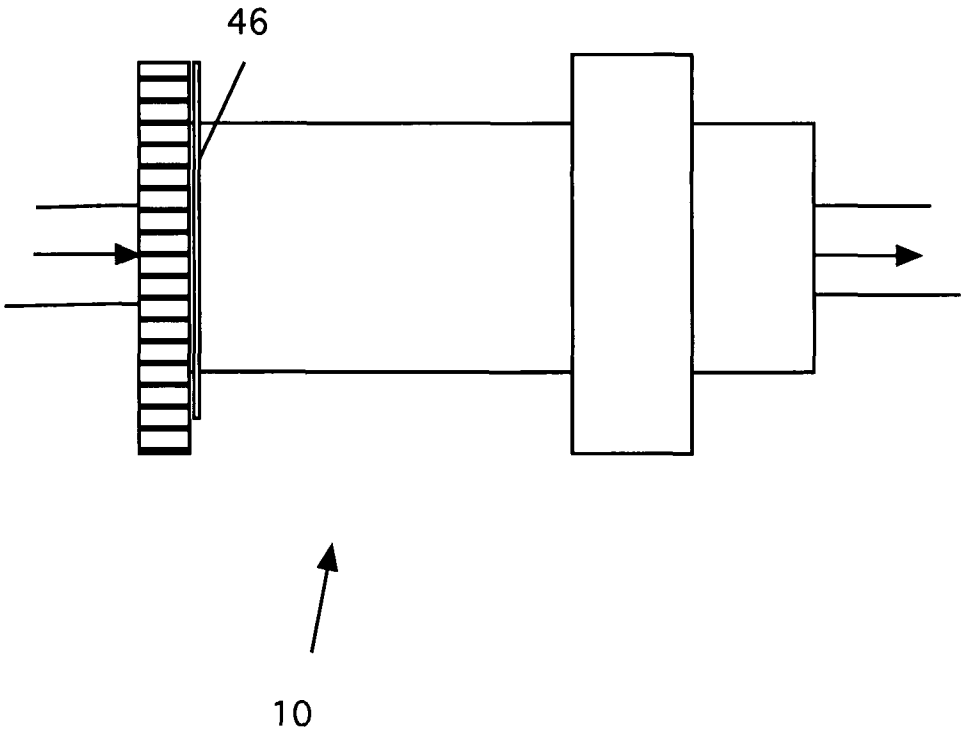
FIG. 13 is a side view of the combine of the second embodiment showing the seals being attached to the combine.

FIG. 13 is a side view of the combine of the second embodiment showing seals 46 being directly attached to the combine 10, instead of being attached to the lubrication fuel injector housing as shown in FIG. 10.

Figure 14:
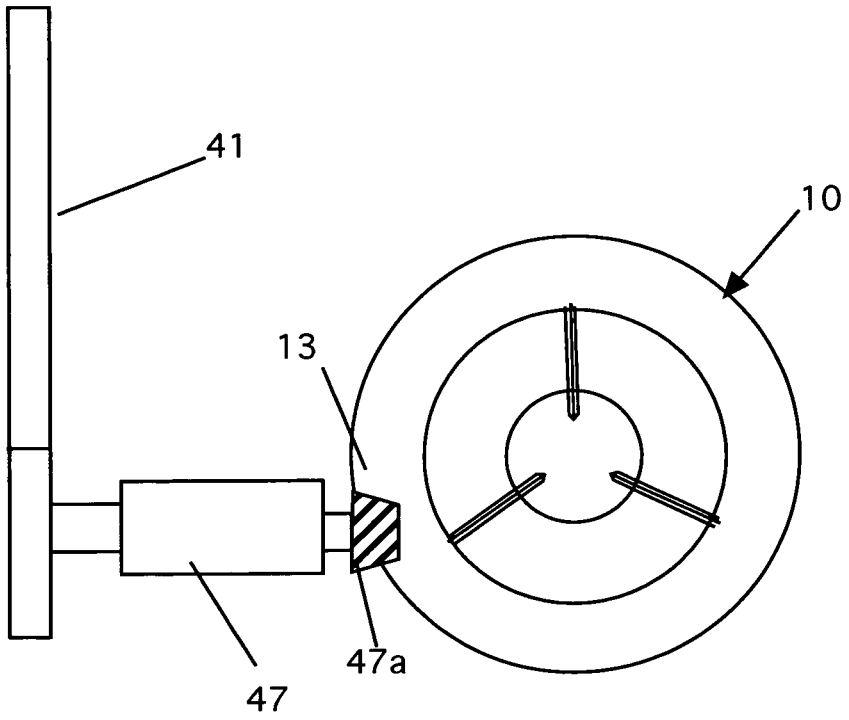
FIG. 14 is a top detail view of the second embodiment being a belt drive system.

FIG. 14 is a top detail view of the second embodiment being a belt drive system. In this figure, the combine 10 is shown with an alternative design. The belt system 41 is used to drives the combine. The belt system is considered to be another of the means for turning said housing. A gear system 47, including a drive gear 47*a* is interposed between the belt shaft and the combine gear 13. This gear can be a hypoid, or bevel gear.

Figure 15:
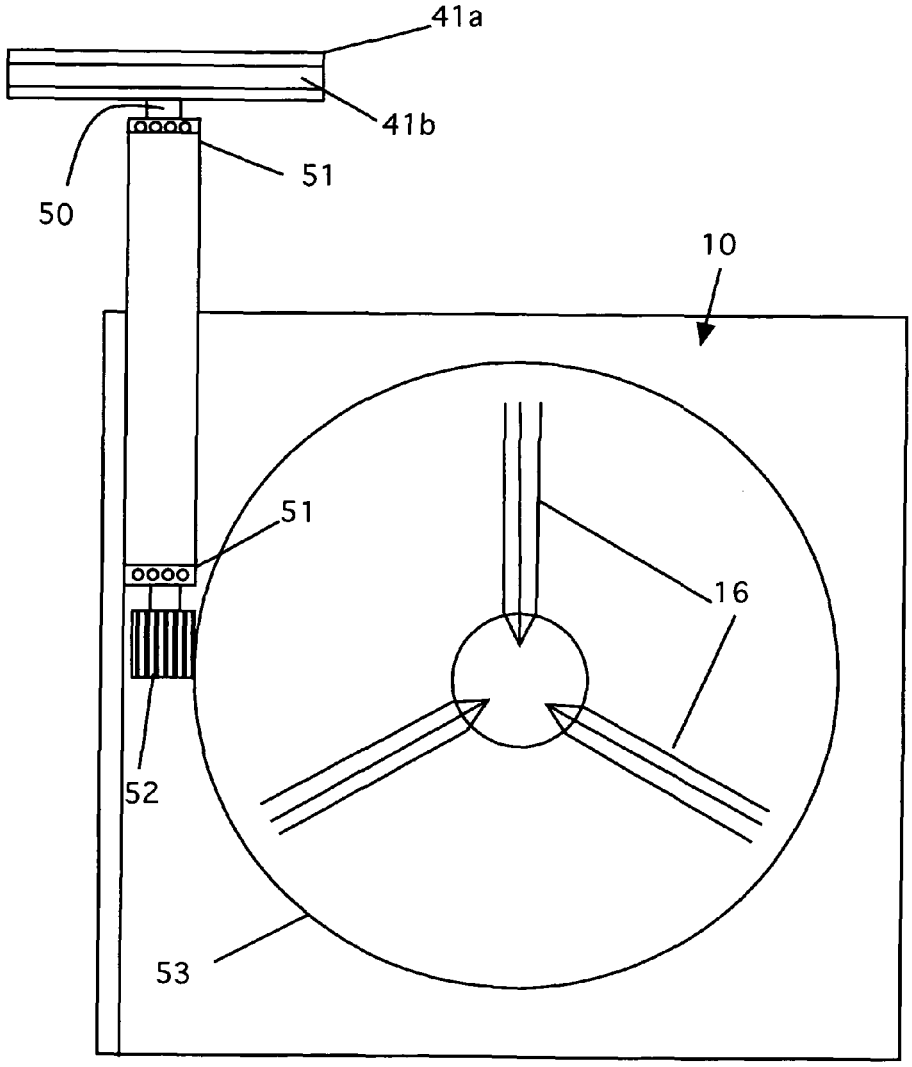
FIG. 15 is a top detail view of a variation of the second embodiment belt drive system.

FIG. 15 is a top detail view of a variation of the second embodiment belt drive system. Here, the combine 10 is shown with an alternative design. The belt system 41 is used to drives the combine as before. It has a pulley 41*a* and a belt 41*b*. A shaft 50 extends back from the pulley. Bearings 51 support the shaft gear 13. At the end of the shaft is a gear 52 that meshes with the combine gear 53. The shaft gear 52 can be a hypoid, or bevel gear, or a spiral gear.

Figure 16:
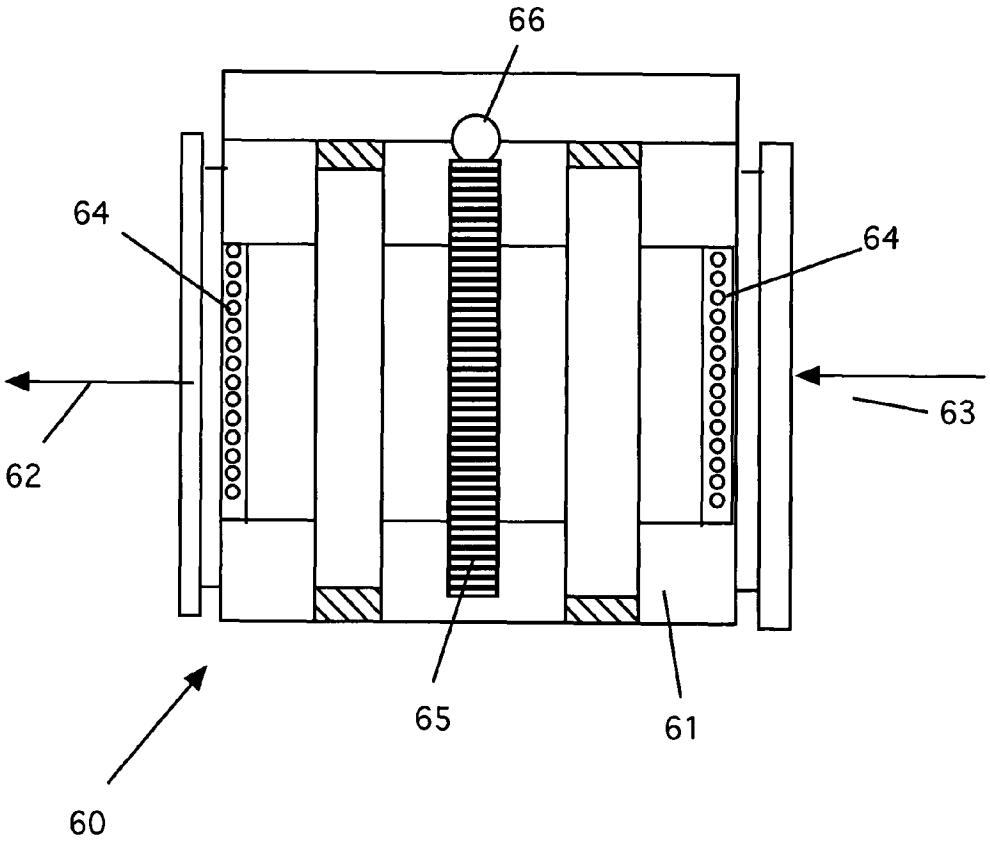
FIG. 16 is a rear view of the combine showing an alternate gear connection.

FIG. 16 is a rear view of the combine showing an alternate gear connection. In this view, the combine 60 has a housing 61, an outlet 62 and an inlet 63. The inlet 63 is the top of the combine. Thrust bearings 64 are placed at the ends of the combine as shown, to support the device. In the center of the combine a gear 65 is positioned. At the left side of the combine, a drive gear 66 is positioned to engage the combine gear. This gear can be a crown gear, a hypoid gear, a bevel gear, or a straight cut gear.

Figure 17:
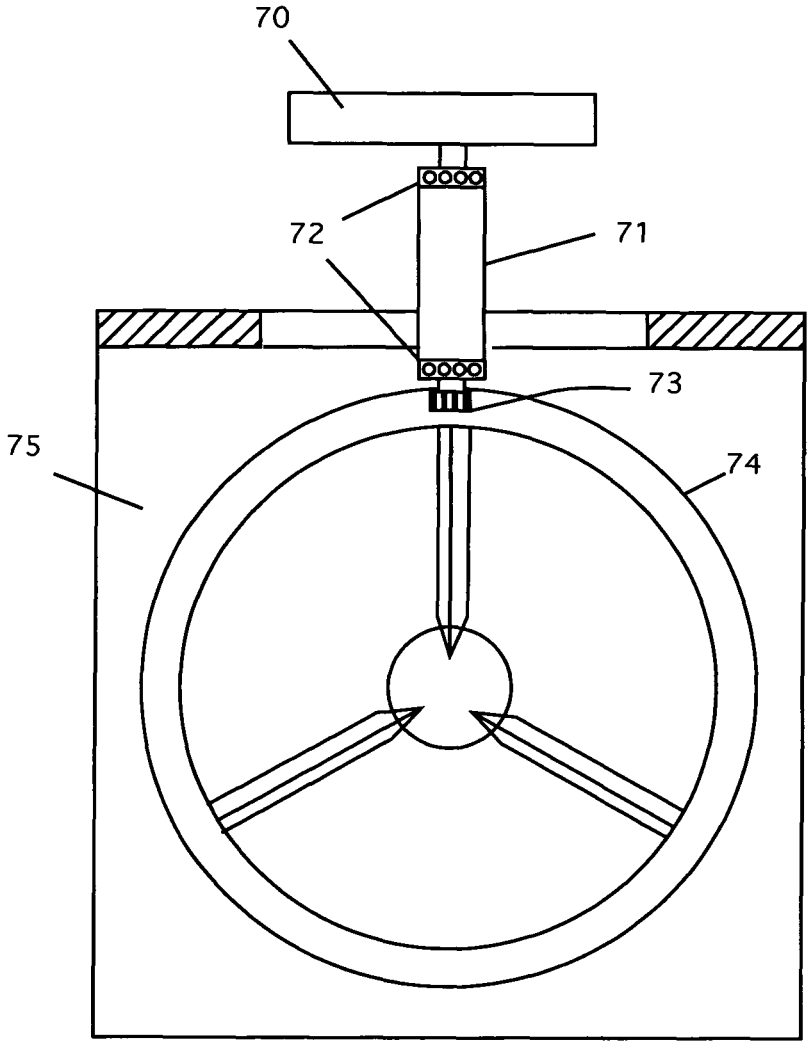
FIG. 17 is a top view of a combine showing another gear arrangement.

FIG. 17 is a top view of a combine showing another gear arrangement.

Here, the belt and pulley 70 drive a shaft 71 that is supported by bearings 72. At the end of the shaft, a gear 73 drives the gear 74 of the combine 75. In this embodiment, the gear can be a crown gear, a hypoid gear, or a bevel gear.

Figure 18:
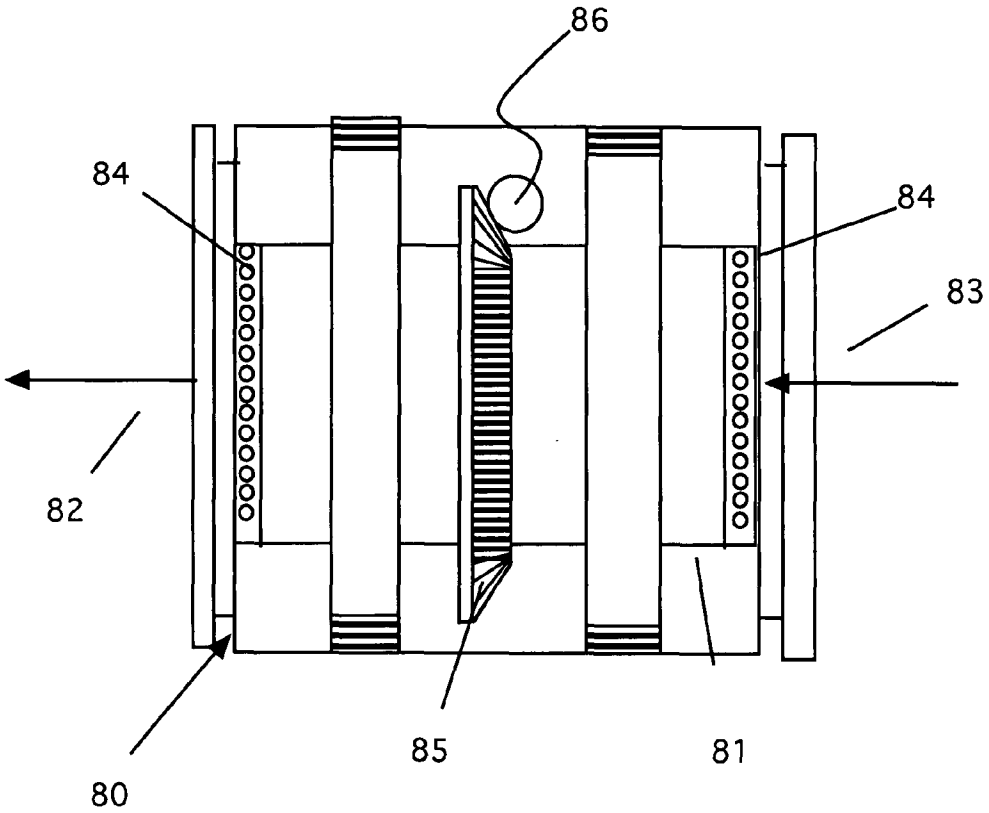
FIG. 18 is yet another view of a combine showing a crown gear arrangement.

FIG. 18 is yet another view of a combine showing a crown gear arrangement. Here, the combine 80 has a housing 81, an outlet 82 and an inlet 83. The inlet 83 is the top of the combine. Thrust bearings 84 are placed at the ends of the combine as shown, to support the device. In the center of the combine a gear 85 is positioned. At the left side of the combine, a drive gear 86 is positioned to engage the combine gear. This gear can be a crown gear, a hypoid gear, a bevel gear, or a straight cut gear.

Figure 19:
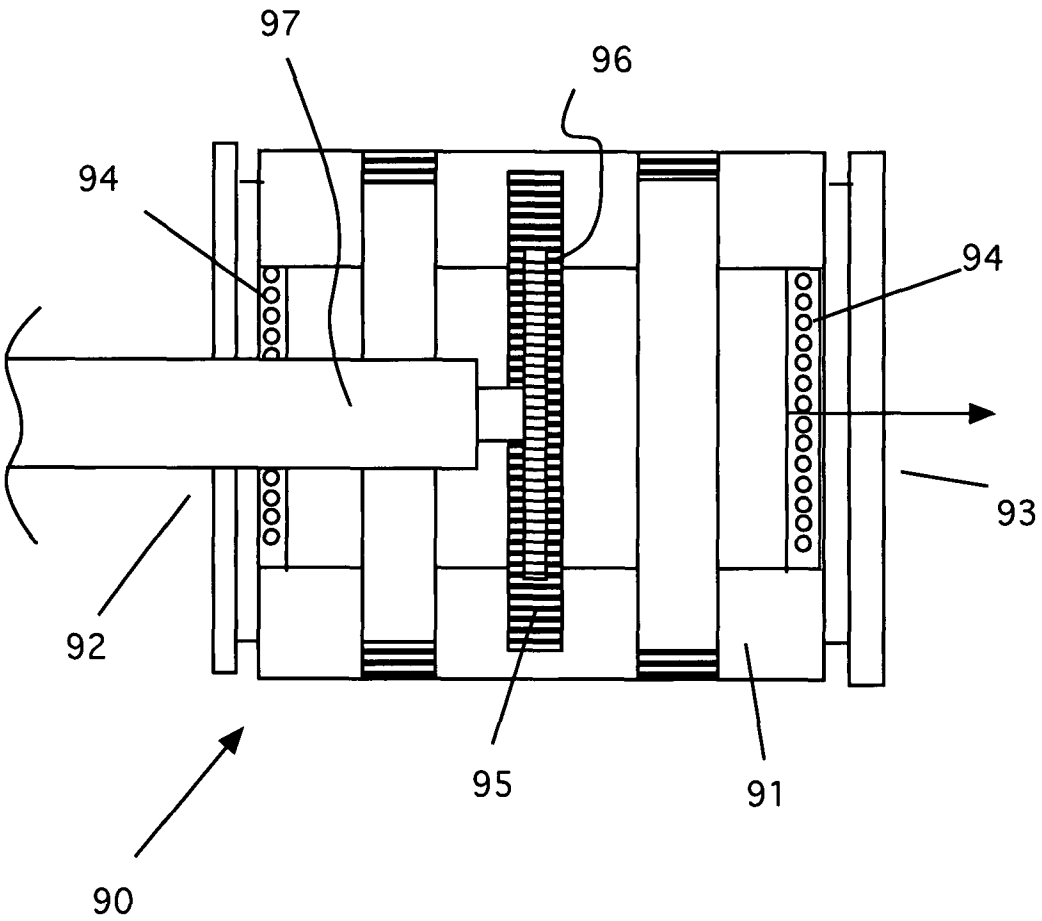
FIG. 19 is another view of a combine with straight cut gears.

FIG. 19 is another view of a combine with straight cut gears. In this view, the combine 90 has a housing 91, an outlet 92 and an inlet 93. The inlet 93 is the top of the combine. Thrust bearings 94 are placed at the ends of the combine as shown, to support the device. In the center of the combine a gear 95 is positioned. On the side of the combine a drive gear 96 is positioned on a shaft 97, to engage the combine gear. This gear is a straight cut gear.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An atomizer system for improved fuel systems for an engine comprising:

a) a housing, being generally cylindrical and having an inlet and an outlet to create a through flow, an inner wall surface, and an outer surface, said housing also having a means for driving said housing installed on the outer surface of the housing;

b) a plurality of vanes, installed in said housing and being fixedly attached to said inner wall surface, each of said plurality of vanes, extending perpendicularly inward from said inner wall surface, such that said plurality of vanes protrudes into said through flow; and c) a means for turning said housing, being in operative communication with said means for driving said housing.

2. The atomizer system for improved fuel systems of claim 1 wherein the means for driving said housing include a gear attached to said housing.

3. The atomizer system for improved fuel systems of claim 1 wherein the means for turning said housing include:

a) a motor, having a shaft; and b) a gear, attached to said shaft and installed such that the gear operatively engages the means for driving said housing installed on the outer surface of the housing.

4. The atomizer system for improved fuel systems of claim 3 further comprising: a motor housing for containing said motor.

5. The atomizer system for improved fuel systems of claim 4 wherein the motor housing further comprises:

a) an air inlet tube; and b) an air outlet tube;

c) wherein air is supplied to said motor housing through said air inlet tube and removed by said air outlet tube, to remove debris from said motor housing.

6. The atomizer system for improved fuel systems of claim 5 further comprising a filter attached to said air outlet tube and said air inlet tube external of said motor housing.

7. The atomizer system for improved fuel systems of claim 1 wherein the means for turning said housing include:

a) a pulley, having a shaft;

b) a belt, operatively attached to said pulley, and a drive pulley of an engine; and b) a gear drive, attached to said shaft and installed such that the gear drive operatively engages the means for driving said housing installed on the outer surface of the housing.

8. The atomizer system for improved fuel systems of claim 7 wherein the gear drive is selected from the group of: bevel gears, crown gears and hypoid gears and straight cut gears.

9. The atomizer system for improved fuel systems of claim 1 wherein a quantity of fuel is injected into said inlet.

10. The atomizer system for improved fuel systems of claim 9 wherein the quantity of fuel injected into said inlet is forced through said housing and out through said outlet.

11. The atomizer system for improved fuel systems of claim 10 wherein the quantity of fuel is atomized by said plurality of vanes in said housing.

12. The atomizer system for improved fuel systems of claim 1 further comprising a computer control in operative communication with said engine and said means for turning said housing.

13. A method of atomizing fuel for use in fuel systems using a rotating combine having a housing, being generally cylindrical and having an inlet and an outlet to create a through flow, an inner wall surface, and an outer surface, said housing also having a means for driving said housing installed on the outer surface of the housing, a plurality of vanes, installed in said housing and being fixedly attached to said inner wall surface, each of said plurality of vanes, extending perpendicularly inward from said inner wall surface, such that said plurality of vanes protrudes into said through flow, a means for turning said housing, being in operative communication with said means for driving said housing, and a means for controlling said means for turning said housing being in operative communication with an engine, comprising the steps of:

a) installing said housing into said fuel system;

b) rotating said housing said means for turning said housing;

c) injecting a quantity of fuel into said housing;

d) having said plurality of vanes rotate through said quantity of fuel, thereby atomizing said quantity of fuel; and e) releasing said atomized quantity of fuel from said housing into said fuel system.

14. The method of claim 13 wherein the means for means for driving said housing includes a gear drive system.

15. The method of claim 14 wherein the gear drive system is selected from the group of: bevel gears, crown gears and hypoid gears and straight cut gears.

16. The method of atomizing fuel of claim 13 wherein the means for turning said housing include:

a) a motor, having a shaft; and b) a gear, attached to said shaft and installed such that the gear operatively engages the means for driving said housing installed on the outer surface of the housing.

17. The method of atomizing fuel of claim 16 further comprising: a motor housing for containing said motor.

18. The method of atomizing fuel of claim 17 wherein the motor housing further comprises:

a) an air inlet tube; and b) an air outlet tube;

c) wherein air is supplied to said motor housing through said air inlet tube and removed by said air outlet tube, to remove debris from said motor housing.

19. The method of atomizing fuel of claim 13 wherein the means for turning said housing include:

a) a pulley, having a shaft;

b) a belt, operatively attached to said pulley, and a drive pulley of an engine; and b) a gear drive, attached to said shaft and installed such that the gear drive operatively engages the means for driving said housing installed on the outer surface of the housing.

20. The method of atomizing fuel of claim 19 wherein the gear drive is selected from the group of: bevel gears, crown gears and hypoid gears and straight cut gears.

* * * * *